US005138137A

United States Patent [19]

Holling et al.

[11] Patent Number: 5,138,137

[45] Date of Patent: Aug. 11, 1992

[54] FAULT DETECTING MEMBRANE POTENTIOMETER SWITCH

[75] Inventors: Ronald W. Holling; Robert R. Williams, both of Lincoln Township, Berrien County, Mich.

[73] Assignee: Whirlpool Corporation, Benton Harbor, Mich.

[21] Appl. No.: 634,579

[22] Filed: Dec. 27, 1990

[51] Int. Cl.[5] ..... H05B 1/02

[52] U.S. Cl. ..... 219/506; 219/505; 338/114; 341/22; 341/24

[58] Field of Search ..... 219/10.55 B, 492, 506, 219/505, 501, 508, 509; 341/26, 24, 22, 151; 338/99, 92, 95, 114

[56] References Cited

U.S. PATENT DOCUMENTS 4,149,217 4/1979 Tucker ..... 219/492
4,266,118 5/1981 Takase et al. ..... 219/492
4,636,949 1/1987 Longabaugh ..... 219/492
4,920,253 4/1990 Takei ..... 219/492

*Primary Examiner*—Mark H. Paschall
*Attorney, Agent, or Firm*—Baker & Daniels

[57] ABSTRACT

The present invention is a fault detecting membrane potentiometer keyswitch. The keyswitch includes circuitry for providing a reference voltage signal when not activated, so that a faulty switch can be determined by absence of a reference voltage signal. Specifically, the wiper of the membrane potentiometer keyswitch is coupled to the resistive element of the keyswitch intermediate a sensing portion and a reference portion. With this arrangement, as long as the keyswitch is inoperative, the reference portion provides a reference voltage signal which is distinguishable from any of the setting voltage signals, and also distinguishable from a grounded condition. When a setting signal is observed, a timer is used to determined whether the setting signal is a user entered setting signal or a short between the wiper and the resistive element.

20 Claims, 2 Drawing Sheets

FAULT DETECTING MEMBRANE POTENTIOMETER SWITCH

BACKGROUND OF THE INVENTION

1. Field of the Invention

The present invention relates to membrane potentiometer keyswitches for use with a domestic appliance control. More specifically, the field of the invention is that of fault detecting membrane potentiometer keyswitches.

2. Prior Art

Membrane potentiometer switches typically include a resistive element located beneath a flexible membrane keypad. The keypad may be pressed at any point above the resistive element, creating a voltage signal which varies depending on the point where the keypad is pressed Keyswitches of this type are especially suited for use in electronic controls for domestic appliances, such as electric ranges. An example of a keyswitch may be found in U.S. Pat. No. 4,901,074, assigned to the assignee of the present invention, the disclosure of which is hereby incorporated by reference.

On existing membrane potentiometer keyswitches, the switch is open-circuited when the keypad is not pressed, so no voltage signal is provided at the switch output. If the resistive element fails for some reason, the switch will be open-circuited even when the keypad is pressed. The key will not generate a voltage signal at the switch output, and the control will not recognize that the user has attempted to enter a command. This could be particularly dangerous if the failed keyswitch was the "off" switch on an electric surface element of an electric range. In this case, a range operator could not turn off the surface element.

Membrane potentiometer switches are used as input devices on various types of controls, including electronic controls for domestic appliances. The advantage of this type of switch is that it permits the user to simultaneously input a command for an action along with the magnitude of the action desired. For example, the operator of an electric range could turn on a selected surface unit to a "medium" heat level simply by pressing the appropriate switch for the selected surface unit at the appropriate point for "medium" heat. Another benefit of using this type of switch on a cooking appliance is that the switch has a smooth surface, permitting easy cleaning of the appliance.

A prior art membrane potentiometer keyswitch is shown in FIG. 3, and includes resistive element 6 which is connected between direct current voltage source 8 and ground 10, creating a voltage drop across resistive element 6. Conductive wiper 12 is spaced away from resistive element 6 and is physically attached to a flexible membrane keypad (not shown). Wiper 12 is also electrically connected to switch output line 14. The flexible membrane keypad typically includes some type of decorative overlay which indicates the proper point to press for a desired magnitude of action.

When the flexible membrane of the keypad is pressed, wiper 12 contacts resistive element 6 at the point pressed, and provides a voltage signal to switch output line 14. The magnitude of the voltage signal depends on the resistance of the portion of resistive element 6 between the point of contact with wiper 12 and ground potential. Switch output line 14 delivers the voltage signal to analog-to-digital (A/D) converter and processor 16 which translates the observed voltage into a command signal for the appliance.

However, processor 16 cannot distinguish between the case when the keypad is not depressed, and the case when switch output line 14 is severed and the switch is inoperative. For example, if a surface heating element of a range is activated by such a keyswitch and a cooking pan was dropped so as to render the keyswitch inoperative, there would be no way of turning off the heating element by conventionally pressing the control panel keyswitches.

What is needed is a fault detecting membrane potentiometer keyswitch for a range or other appliance which prevents locking the appliance in an activated condition.

Also needed is a membrane potentiometer keyswitch which indicates when the switch is faulty.

Another need is for a membrane potentiometer keyswitch which provides distinct indications of non-activated and inoperative switches.

SUMMARY OF THE INVENTION

The present invention is a fault detecting membrane potentiometer switch which provides a small reference voltage signal at the switch output when the key pad is not pressed so that the appliance control recognizes that the keyswitch is functional. If the resistive element fails in either an open or shorted condition, the signal at the switch output will deviate from the expected reference voltage, and the appliance control will be able to determine that a failure has occurred.

The membrane switch of the present invention electrically connects the wiper across a portion of the resistive element, so that even when the keypad is not pressed, a small reference voltage signal appears at the wiper. The reference voltage is designed to be beneath the normal range of valid input data for the input device. The reference voltage is monitored, and if it deviates outside certain limits a timer is initiated. If the reference voltage does not return to a normal value within a predetermined amount of time, the control determines that a fault has occurred in the keyswitch, and the control deactivates any active circuitry.

The control is able to detect both open- and short-circuit failures of the resistive element. An open-circuit appears as a voltage lower than the normal reference voltage or any valid data input. A short-circuit appears as a voltage higher than the normal reference signal which does not terminate after a predetermined period of time. The reference voltage is designed to be beneath the normal range of valid input data for the control, so that the control can accurately distinguish the reference voltage from actual keypad input data.

The membrane potentiometer is advantageously used as the input to an A/D converter. The A/D converter requires fewer input lines than a standard keyboard grid. The A/D converter also offers high resolution by distinguishing between a great many voltage levels, permitting the appliance control to distinguish easily and accurately between valid data signals and the reference signal.

One object of the present invention is to provide a fault detecting membrane potentiometer keyswitch for a range or other appliance which prevents locking the appliance in an activated condition.

Another object is to provide a membrane potentiometer keyswitch which indicates when the switch is faulty.

A further object is to provide a membrane potentiometer keyswitch which provides distinct indications of non-activated and inoperative switches.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

DESCRIPTION OF THE PREFERRED EMBODIMENT

Figure 1:
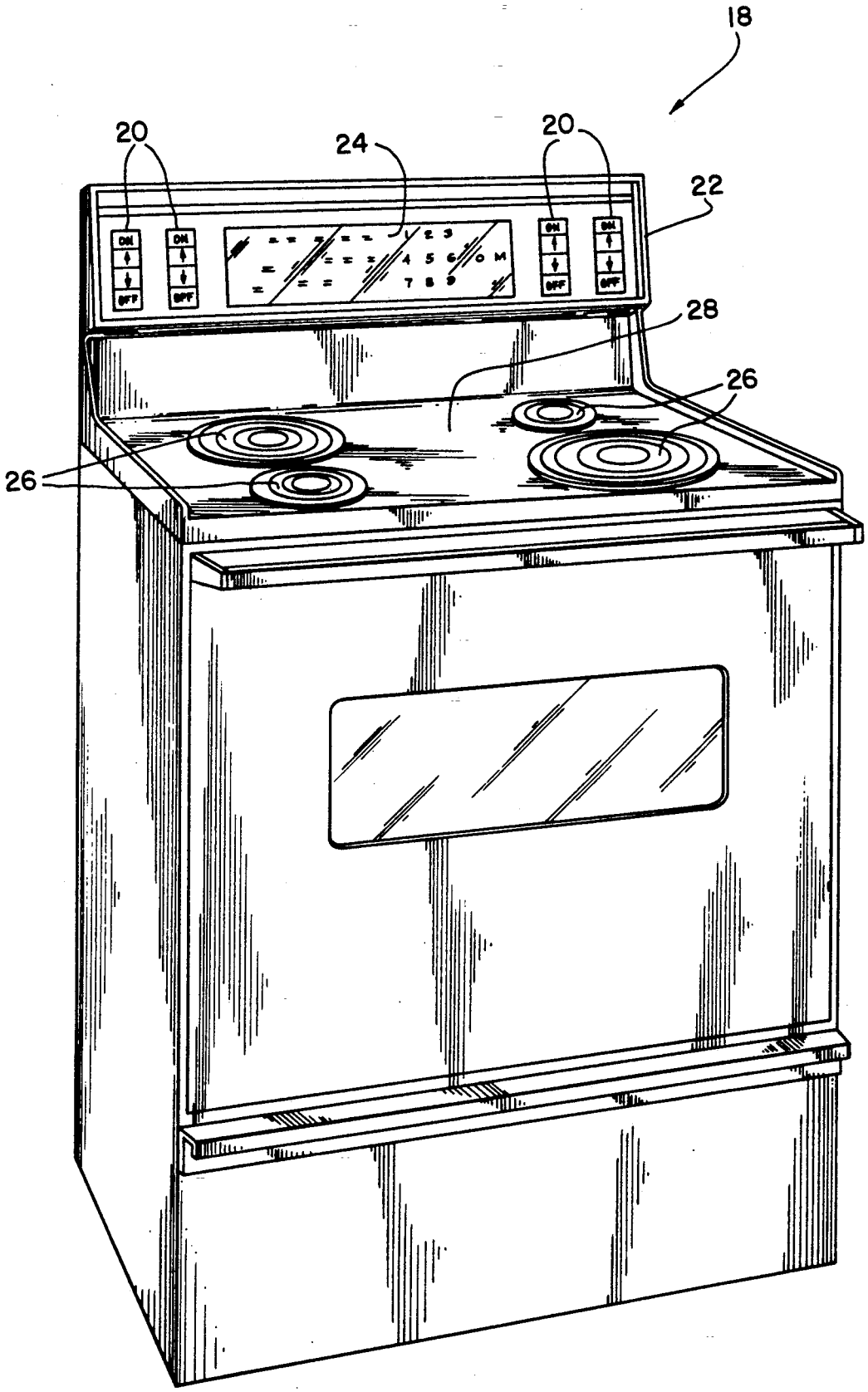
FIG. 1 is a perspective view of a range having the fault detecting membrane potentiometer keyswitch of the present invention.

The present invention is a fault detecting membrane potentiometer keyswitch for use in a domestic appliance such as range 18 of FIG. 1. Keyswitches 20 are located on upper extension 22 and are disposed in pairs on opposite sides of control panel 24 Each keyswitch 20 controls the operative setting of a corresponding surface heating element 26 on upper surface 28 of range 18. Surface heating elements 26 may be any suitable heating element, for example, an electric resistance heater.

Figure 2:
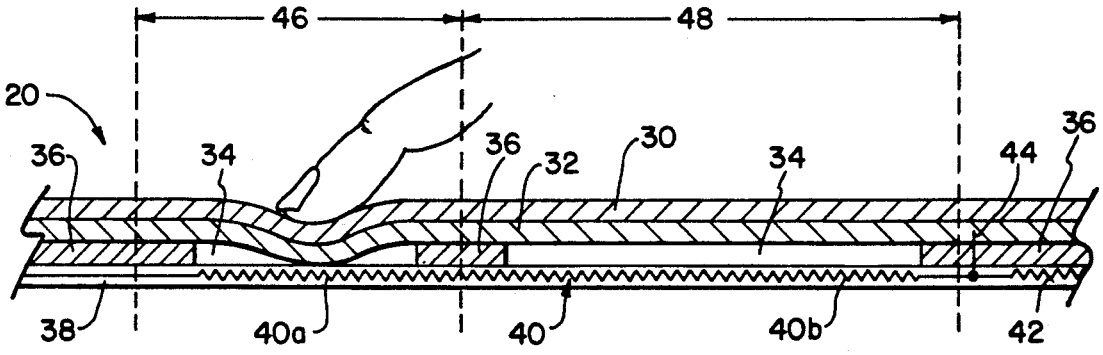
FIG. 2 is a cross-sectional view of the keyswitch of the present invention.
Figure 3:
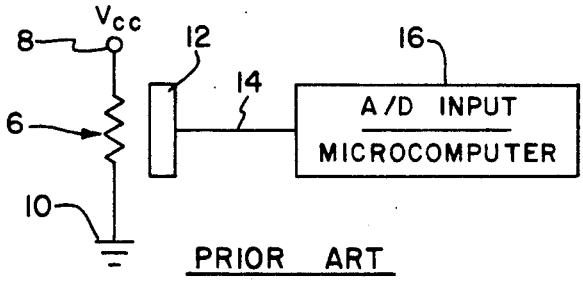
FIG. 3 is a circuit diagram of a prior art membrane potentiometer keyswitch.

A cross-sectional view of keyswitch 20 is shown in FIG. 2. The outer layer of keyswitch 20 includes flexible membrane 30, which may also contain a decorative overlay which indicates which setting is activated by pressing membrane 30 at that point. The second layer of keyswitch 20 includes conductive wiper 32, which may be as flexible as membrane 30, but must in any event be able to bend inwardly in response to a human touch. The third layer of keyswitch 20 primarily includes air layer 34, although spacers 36 are disposed between wiper 32 and resistive element 38 so that normally wiper 32 and resistive element 38 do not contact. The base layer of keyswitch 20 includes resistive element 38 which comprises sensing portion 40 and reference portion 42. Connecting line 44 extends from wiper 32 to resistive element 38 between sensing portion 40 and reference portion 42.

Sensing portion 40 extends between spacers 36 and faces air layer 34, so that wiper 32 is capable of establishing an electrical connection at any point over the exposed surface of sensing portion 40. Keyswitch 20 includes on/off button portion 46 and setting portion 48 which are separated by one of the spacers 36. On/off button 46 is located directly above air layer 34 and on/off portion **40*a* of sensing portion 40, wherein wiper 32 contacting on/off portion 40*a* activates the control for entering a heat setting for the corresponding heating element 26. Setting portion 48 is located directly above air layer 34 and setting portion 40*b* of sensing portion 40, wherein wiper 32 contacting setting portion 40*b*** activates a particular heat setting.

In the operation of the keyswitch 20 to activate one of heating elements 26 to a particular heat setting, on/-off button 46 must be pressed. After pressing on/off button 46, the operator selects the heat setting by pressing on an appropriate position on setting portion 48. In the preferred embodiment, fourteen (14) vacuum fluorescent segments are used to indicate which of the 14 available heat settings is selected. Heating element 26 is activated at the heat setting indicated by the voltage apparent from the point of contact between setting portion 48 and wiper 32.

Figure 4:
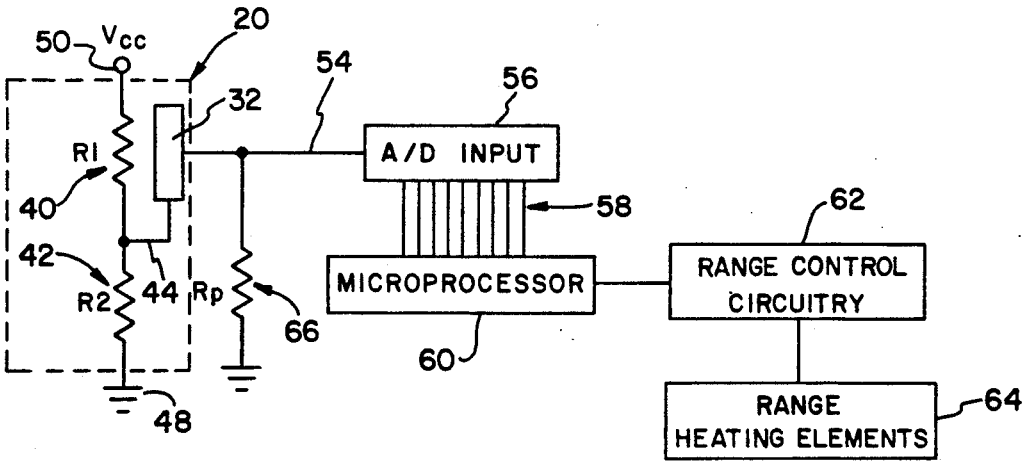
FIG. 4 is a circuit diagram of the keyswitch of the present invention. Corresponding reference characters indicate corresponding parts throughout the several views. The exemplification set out herein illustrates one preferred embodiment of the invention, in one form, and such exemplifications are not to be construed as limiting the scope of the invention in any manner.

FIG. 4 shows a circuit diagram of range 18. Keyswitch 20 is coupled between voltage source 50 (also labeled $V_{CC}$) and ground 52 (indicated by the null symbol). Setting line 54 couples keyswitch 20 to analog-to-digital (A/D) input converter 56, which interprets the voltage signal from wiper 32 as a discrete voltage level and provides a digital signal indicative of that voltage level over digital lines 58 to microprocessor 60. Microprocessor 60 controls the operation of range control circuitry 62 which activates and regulates the provision of power to range heating elements 64.

The setting voltages are the voltage signals which are apparent at wiper 32 when it contacts sensing portion 40 (labeled R1 in FIG. 4), and are variable depending on the location of the point of contact on sensing portion 40. The maximum setting voltage apparent on sensing portion 40 is preferably lower than the power supply voltage. When not contacting sensing portion 40, the voltage signal apparent at wiper 32 is a reference voltage signal established by the resistance of reference portion 42 (labeled R2 in FIG. 4). Preferably, the minimum setting voltage is higher than the reference voltage which is preferably higher than ground. Also, to prevent an open switch from letting the A/D input converter 56 float thereby allowing noise to be recognized, pull-down resistor 66 (labeled Rp in FIG. 4) is coupled between setting line 54 and ground 52, and in parallel with reference portion 42.

In accordance with the present invention, A/D input converter 56 includes fault detecting circuitry for distinguishing between the reference voltage signal and all other voltage signals. When A/D input converter 56 observes a voltage signal which is not the reference voltage, the fault detecting circuitry starts a timer for a certain waiting period, for example, in the range of 8 to 15 seconds, preferably 12 seconds. If the timer expires without the cessation of the non-reference voltage signal, the fault detecting circuitry of microprocessor 60 shuts down the surface heating element 26 corresponding to the keyswitch 20 causing the non-reference voltage signal. The non-reference voltage signal could be a ground, indicating that the switch is no longer properly connected. Another possibility is that wiper 32 has shorted at some point on sensing portion 40, which will result in the observed voltage signal continually staying in the setting range, indicating that the switch is no longer properly connected. In either case, the persistence of a non-reference voltage signal on setting line 54 causes the associated heating element 26 to be inoperative and the display segments to flash indicating inoperability.

In the exemplary embodiment, the voltage signal output of keyswitch 20 is connected to an 8 bit analog-to-digital converter 56. The 8 bit output of converter 56 is input to microprocessor 60 which operates as part of an electronic control for electric range 18. Preferably, converter 56 is an on board component of the circuitry of microprocessor 60 and can distinguish between 256 different voltage levels from ground to a predetermined maximum voltage, which depends on the power supply. Converter 56 utilizes a 5 volt (V) DC supply, and has a valid input data range of 1.3 to 4.7 V. The reference voltage is 0.45 V. If the reference voltage is greater than 0.6 V or less than 0.3 V for more than 12 seconds, the fault detecting circuitry of microprocessor 60 detects a failure and shuts down the surface heating element 26 of the range which is de-activated by the faulty keyswitch 20.

The heating elements 26 which remain operative are those associated with the keyswitches 20 which continue to provide the reference voltage signal to converter 56. The heating element 26 associated with the faulty keyswitch 20 remains disabled until its faulty key switch is repaired or replaced with a new keyswitch which provides the reference voltage signal when not pressed. Thus, although the malfunction of one keyswitch 20 renders its associated heating element 26 inoperative, the other three heating elements 26 continue normal operation under the control of the properly functioning keyswitches.

Sensing portion 40 of resistive element 38, in the exemplary embodiment, has a resistance of 10 kilo-ohms (Kohm), while reference portion 42 of resistive element 38 has a resistance of 910 ohms. 100 KOhm pull-down resistor 66 is also coupled to setting line 54 in parallel with reference portion 42 of resistive element 38. Reference portion 42 has a sufficiently large resistance to prevent excessive current flow if sensing portion 40 shorts out. In the exemplary embodiment, reference portion 42 draws approximately 5 milliAmps (mA) from the supply voltage in the event of a short of sensing portion 40, and dissipates approximately 0.03 watts (W) of power.

Wiper 32 should preferably be directly connected to the circuit which includes sensing portion 40 and reference portion 42, as shown in FIG. 4. If keyswitch 20 is arranged with line 44 disposed between setting line 54 and reference portion 42, setting line 54 may break near wiper 32 and cause keyswitch 20 to be inoperative, but A/D input converter 56 may still receive the reference voltage signal over the line between setting line 54 and reference portion 42 and assume that a failure had not occurred.

The voltage signals generated by the reference resistor that indicates the operability of the keyswitch can be of many forms, such as voltage levels as disclosed, logic levels, polarity, current levels, etc. The present invention is therefore not limited to only the disclosed embodiment.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An improved membrane potentiometer switch comprising a resistance element for generating a continuous voltage drop between a predetermined maximum voltage and a predetermined minimum voltage, and a conductive member selectively contactable with said resistance element for generating a voltage data signal having a magnitude between said predetermined maximum and minimum voltages only when said conductive member is in contact with said resistive element, wherein the improvement to said membrane potentiometer switch comprises:

a reference voltage means for continuously generating and providing a voltage reference signal on said conductive member when said conductive member is not in contact with said resistive element.

2. The membrane potentiometer switch of claim 1 wherein said reference voltage means comprises a reference element and a connecting line which electrically connects said conductive member to said reference element whereby a voltage reference signal is apparent on said conductive member when said conductive member is not in contact with said resistive element.

3. The membrane potentiometer switch of claim 1 wherein said reference voltage signal has a magnitude less than said predetermined minimum voltage.

4. An electronic control for an appliance including a membrane potentiometer switch comprising:

a resistance element for generating a continuous voltage drop between a predetermined maximum voltage and a predetermined minimum voltage;

a conductive member selectively contactable with said resistance element for generating a voltage data signal having a magnitude between said predetermined maximum and minimum voltages only when said conductive member is in contact with said resistive element;

an input device for reading said voltage data signal and controlling said appliance;

reference voltage means coupled to said input device for continuously generating a voltage reference signal when said conductive member is not in contact with said resistive element; and fault detection means associated with said input device for detecting the presence of said reference voltage signal and thereby determining whether a fault condition exists in said membrane potentiometer switch.

5. The electronic control of claim 4 wherein said reference voltage means comprises a reference element and a connecting line which electrically connects said conductive member to said reference element whereby a voltage reference signal is apparent on said conductive member when said conductive member is not in contact with said resistive element.

6. The electronic control of claim 4 wherein said reference voltage signal has a magnitude less than said predetermined minimum voltage.

7. The electronic control of claim 4 wherein said reference voltage signal has a non-ground value, and if said reference voltage signal deviates from said non-ground value by more than a predetermined amount, said fault detection means shuts down the appliance.

8. The electronic control of claim 7 wherein said fault detecting means includes a timer for determining whether said reference voltage signal has deviated from said non-ground value for longer than a predetermined time, and said fault detecting means shutting down the appliance only after determining the deviation has occurred for longer than said predetermined time.

9. The electronic control of claim 8 wherein said predetermined time is in the range of 8 to 15 seconds.

10. An appliance comprising:

a heating element;

means for selectively activating said heating element according to a desired setting;

membrane switch means for entering said desired setting and for providing a setting voltage signal to said activating means, said setting voltage signal being within a predetermined voltage range and being indicative of said desired setting, said membrane switch means including means for continuously providing a reference voltage signal to said activating means when said membrane switch means is not activated, said reference signal being outside said predetermined voltage range and being distinct from a ground voltage, said activating means adapted to receive said reference voltage signal and thereby determine the existence of a fault condition in said membrane switch means.

11. The appliance of claim 10 wherein said membrane switch includes a resistance element for generating a continuous voltage drop within said predetermined voltage range between a predetermined maximum voltage and a predetermined minimum voltage, and a conductive member selectively contactable with said resistance element for generating a voltage data signal having a magnitude between said predetermined maximum and minimum voltages only when said conductive member is in contact with said resistive element.

12. The appliance of claim 11 further comprising an input means for receiving said voltage data signal, and said input means providing a control signal to said activating means.

13. The appliance of claim 12 wherein said input means comprises an analog-to-digital converter.

14. The appliance of claim 10 wherein said membrane switch means comprises a resistive element having a signal portion and a reference portion, and said membrane switch means further including a connecting line which electrically connects said conductive member to said reference portion whereby said voltage reference signal is apparent on said conductive member when said conductive member is not in contact with said signal portion.

15. The appliance of claim 10 wherein said reference voltage signal has a magnitude less than said predetermined minimum voltage.

16. The appliance of claim 10 wherein said reference voltage signal has a nominal value, and if said reference voltage signal deviates from said nominal value by more than a predetermined amount, said activating means shuts down said appliance.

17. The appliance of claim 16 wherein said activating means includes a timer for determining whether said reference voltage signal has deviated from said nominal value for longer than a predetermined time.

18. The appliance of claim 17 wherein said predetermined time is in the range of 8 to 15 seconds.

19. The appliance of claim 10 wherein said activating means includes a timer for determining whether said reference voltage signal has deviated from said nominal value for longer than a predetermined time.

20. The appliance of claim 10 wherein said activating means includes a single processor and a single voltage signal converter whereby said single processor and said single voltage signal converter are adapted to receive a plurality of signals indicative of a setting voltage and are adapted to activate a plurality of respective elements capable of heating.

* * * * *